US005426820A

United States Patent [19]

Coleman et al.

[11] Patent Number: 5,426,820

[45] Date of Patent: Jun. 27, 1995

[54] MODULAR REDUCED FRICTION OVERHEAD DOOR HOLDER ASSEMBLY

[75] Inventors: Michael D. Coleman; Theodore J. Fritsch; Herman M. Tilly, all of Indianapolis, Ind.

[73] Assignee: Von Duprin, Inc., Indianapolis, Ind.

[21] Appl. No.: 138,523

[22] Filed: Oct. 15, 1993

[51] Int. Cl.[6] ..... E05F 5/00

[52] U.S. Cl. ..... 16/85; 16/82; 292/277

[58] Field of Search ..... 16/63-65, 16/72, 78, 85; 292/273, 274, 277, 278; 49/394

[56] References Cited

U.S. PATENT DOCUMENTS

| | | | |
|---|---|---|---|
| 2,277,316 | 3/1942 | Garrison | 292/274 |
| 3,601,842 | 8/1971 | Morrisson et al. | 292/274 |
| 3,683,450 | 8/1972 | Morrison et al. | 16/82 |
| 4,750,236 | 6/1988 | Teague, Jr. | 292/278 |
| 5,263,807 | 11/1993 | Pijanowski | 414/480 |

*Primary Examiner*—S. Thomas Hughes
*Assistant Examiner*—Kenneth J. Hansen
*Attorney, Agent, or Firm*—Robert F. Palmero; A. James Richardson

[57] ABSTRACT

An overhead door holder assembly, for attachment between a door jamb and a door, to hold the door in an open position includes a jamb bracket attached to the door jamb and a jamb arm pivotally attached to the jamb bracket. A channel assembly having a longitudinally extending channel is attached to the door, and one of a group of modular slide assemblies that interchangeably fit into the channel assembly can be selected for pivotal attachment to the jamb arm. The slide assemblies have attached polymeric blocks that reduce wear caused by sliding components and may have door hold and door stop provisions as well.

11 Claims, 5 Drawing Sheets

MODULAR REDUCED FRICTION OVERHEAD DOOR HOLDER ASSEMBLY

BACKGROUND OF THE INVENTION

The present invention relates to an overhead door holder assembly, and more particularly, to modular door holder assemblies having interchangeable sliding elements with reduced sliding friction.

Temporarily holding a door in an open position is often necessary for convenience and safety, and one commonly employed method uses an overhead door control device that includes a pivoting arm attached between an upper portion of a door jamb and an upper part of a door. When the door is to be held open at an angle that does not exceed about 110 degrees, such a device is efficient, effective, and convenient to install and maintain. Overhead door control devices are less subject to damage by vandalism or accidents, and do not present a potential stumbling hazard.

However, many conventional overhead door control devices have components that are difficult to install, maintain, or replace. What is needed is an overhead door holder assembly that is durable, has minimal wear sliding component, does not require lubrication, and is easy to install, adjust or replace with minimal effort and expertise. The door holder must be set to permit easy engagement of the door holder, to hold the door against minor amounts of jostling contact without release, and yet to still permit closing the door without undue effort. Ideally, such a door holder will include mechanisms that prevent its damage from violent or forceful door opening.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an overhead door holder assembly, for attachment between a door jamb and a door, for selectively holding the door in an open position, including a jamb bracket attached to the door jamb and a jamb arm pivotally attached to the jamb bracket; a channel assembly having a channel therein; a slide assembly pivotally attached to the jamb arm for movement in the channel in response to opening or closing of the door, with the slide assembly supporting at least one low friction polymeric block in contact with the channel walls.

The foregoing and other aspects will become apparent from the following detailed description of the invention when considered in conjunction with the accompanying drawing figures.

DETAILED DESCRIPTION OF THE INVENTION

Figure 1:
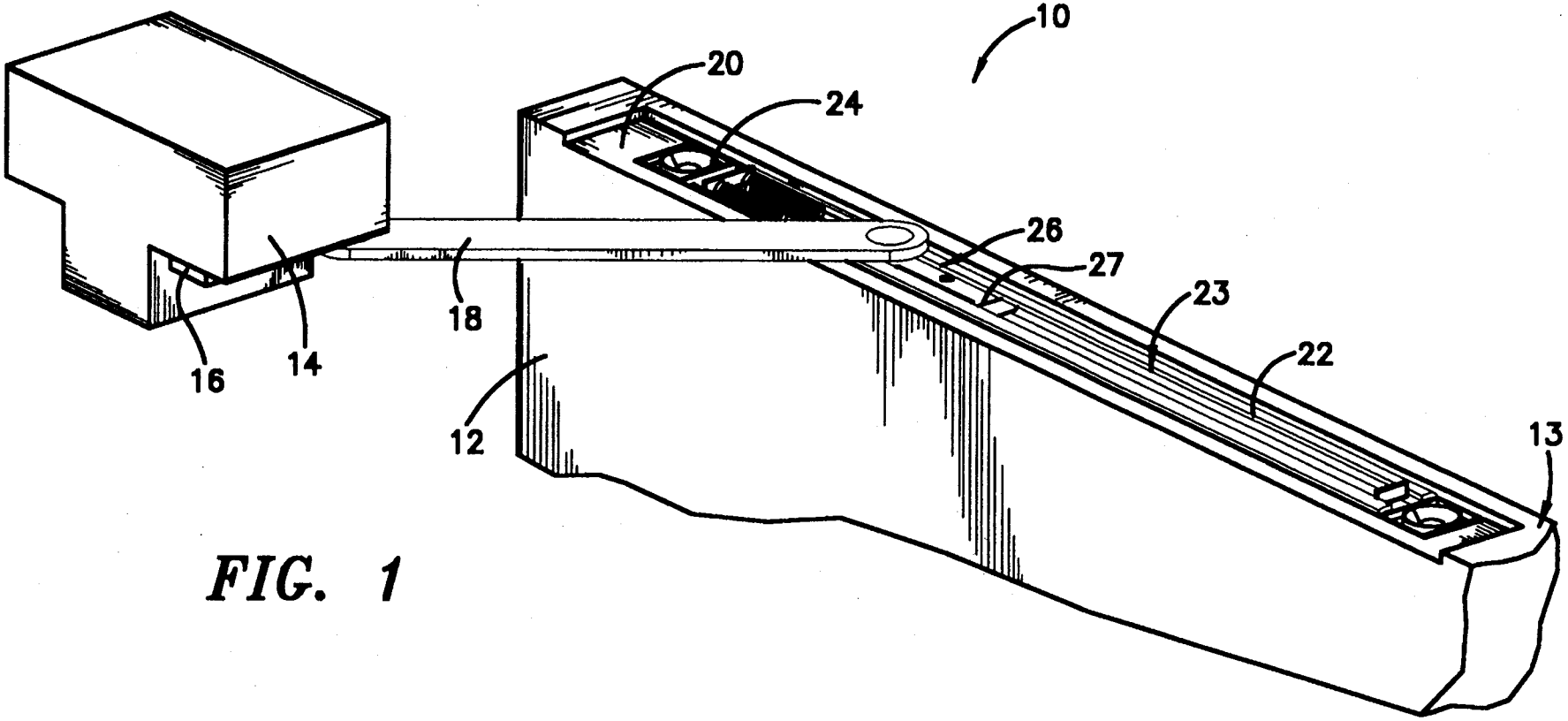
FIG. 1 is a generalized perspective view of an overhead door holder assembly.
Figure 2:
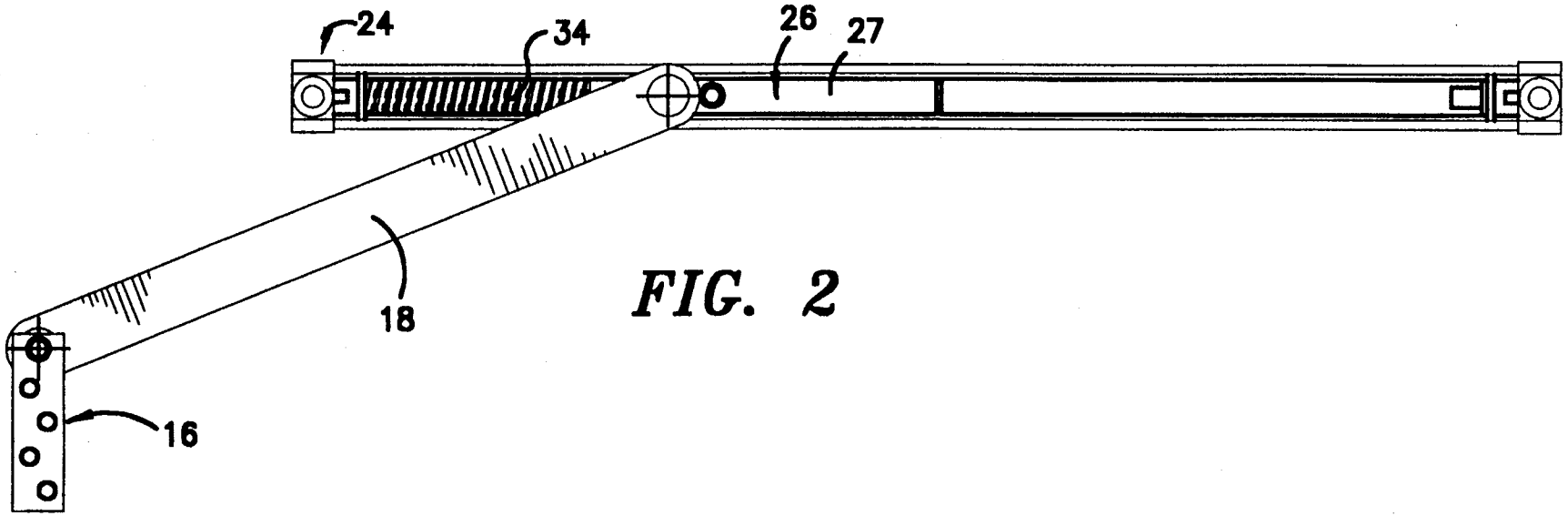
FIG. 2 is a top view of the overhead door assembly of FIG. 1, showing the stop spring and slide assembly set in the channel of the channel assembly.
Figure 3:
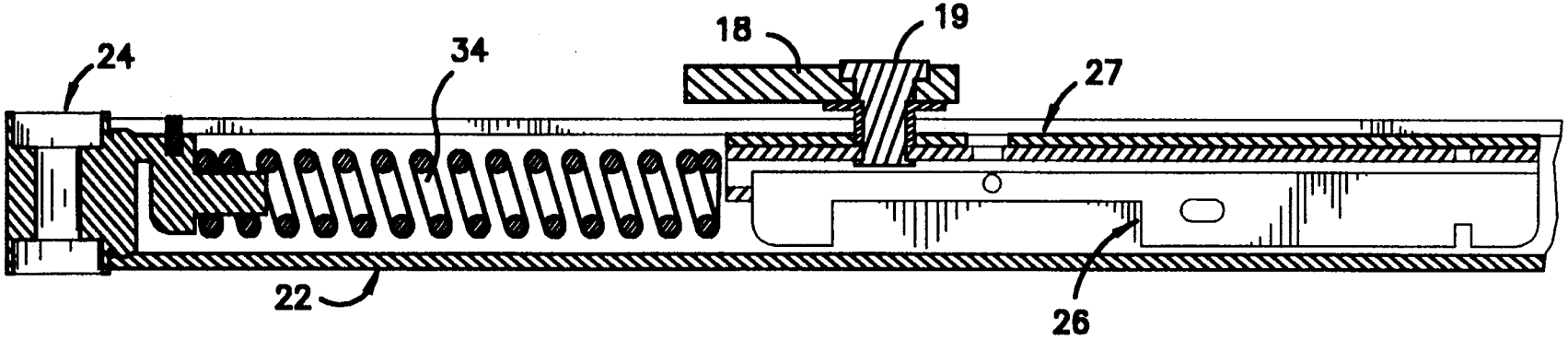
FIG. 3 is a side view of the channel assembly, showing a polymeric block attached to the slide assembly to provide low friction and low wear engagement with the channel assembly.

As illustrated in FIGS. 1, 2, and 3, an overhead door holder assembly 10 has a channel assembly 22 positioned in a door inset 20 at an upper edge 13 of a door 12. The channel assembly 22 is attached to the door 12 so that its longitudinally extending and generally U-shaped channel 23 is upwardly open. Positioned for sliding movement within the channel 23 is a slide assembly 26.

In accordance with the present invention, the slide assembly 26 has an attached polymeric block 27 for contacting the channel assembly 22 to reduce sliding friction and wear. Typically, the low friction polymeric block is constructed from durable, inexpensive, and low friction materials such as nylon filled thermoplastic. A favored nylon filled thermoplastic is Nylatron ®, produced by Polymer Corporation, of Reading, Pennsylvania. Use of the polymeric block 27 extends the useful wear life of the channel assembly 22 and slide assembly 26, eliminates the need for periodic lubrication with oils or solid lubricants such as graphite, and reduces noise of door opening or closing.

The door holder assembly 10 also includes a jamb bracket 16 permanently affixed by screws, bolts, rivets, or other fasteners to a door jamb 14. A jamb arm 18 is pivotally connected at one end to the jamb bracket 16 and at its opposite end to the slide assembly 26 by pin 19. In preferred embodiments, the jamb bracket 16, jamb arm 18 and channel assembly 22 are formed from extruded brass or other durable, wear resistant material such as steel.

When the door 12 is closed, the slide assembly 26 is positioned in the channel 23 distant from the spring support 24. As the door 12 is opened, as shown in FIG. 1, the pivoting connection of the jamb arm 18 between the jamb bracket 16 and the slide assembly 26 allows the slide assembly 26 to move along the channel 23 toward a spring support 24. When force is applied to open the door, the slide assembly 26 moves along the channel toward the spring support 24 until the slide assembly contacts and rebounds from the stop spring 34. The stop spring 34 absorbs the force of slider movement, preventing damage to the door or door holder assembly 10. Of course, conventional compression springs are not required to be fitted into the channel assembly. In alternative embodiments, polymeric or steel blocks can be fitted in the channel assembly to absorb force of the slider, and other mechanisms for engaging the slider can also be attached to the channel assembly.

Figure 4:
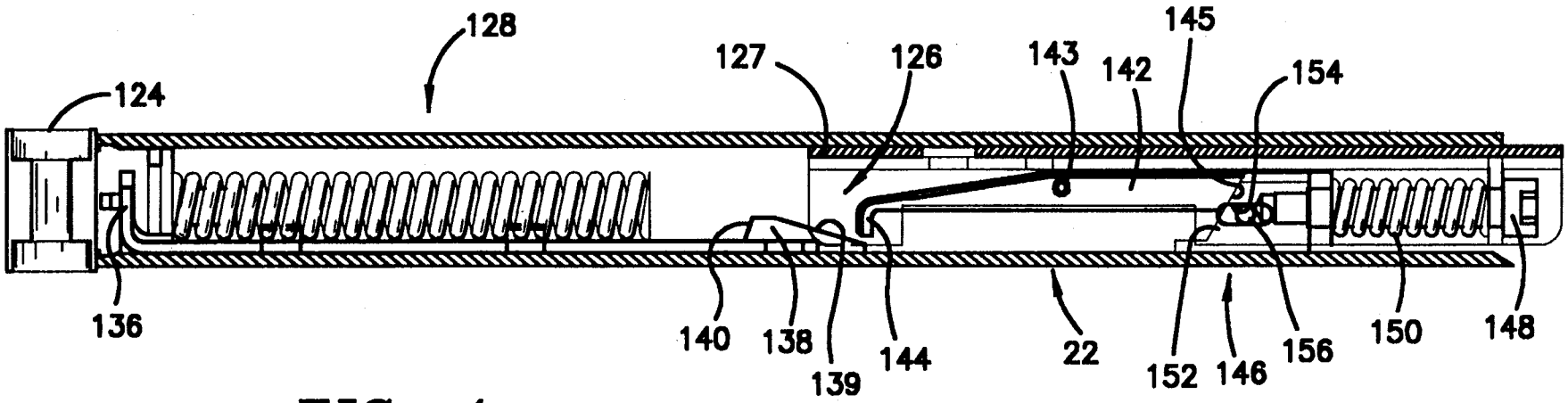
FIG. 4 is side view of an alternative modular slide assembly constructed by modification of the slide assembly of FIGS. 1–3.

For example, as best illustrated in FIG. 4, modularization in accordance with the present invention allows simple and easy modification of a the slide assembly for different functions. A hold open stop 128, formed from stamped metal and configured for permanent insertion into the channel assembly 22. The hold open stop 128 has an integrally formed flange 136 that can be snapped into a slot formed in the spring support 124 for locking engagement. At its end opposite from the flange 136, the hold open stop 128 has a stop element 138. The stop element 138 has angled and opposed first and second ramps 139 and 140. The first ramp 139 is typically configured to present a wedge shape surface having a dihedral angle of between about 10 degrees to about 40 degrees, with an angle of 25 to 35 degrees being typical. The dihedral angle presented by the second ramp 140 is much steeper, having a range of between about 50 degrees to about 85 degrees, with angles of 65 degrees to 75 degrees being typical.

The stop element 138 engages slide assembly 126 to hold open door 12. The slide assembly 126 includes an axle pin 143 for pivotally supporting a rocker 142, and an adjustment wedge 146 to permit altering the force exerted by the rocker 142 on the stop element 138 of the hold open stop 128. The adjustment wedge 146 has an internally defined wedge slot 154 through which passes a position pin 156 connected to the slide assembly 126. The position of the adjustment wedge 146 is itself adjusted by an adjustment screw 148 that engages a compression spring 150 situated between a head of the screw 148 and the adjustment wedge 146.

Engagement of the slide assembly 126 and the hold open stop 128 requires a catch 144 of the rocker 142 to contact the stop element 138 of the hold open stop 128. The catch 144 moves upward on the first ramp 139 of the stop element 138 as the slide assembly moves closer to the hold open stop 128, and ultimately slides down the second ramp 140 of the stop element 138 to a position of locked engagement with the second ramp 140 of the stop element 138, holding the door in an open position. Essentially, a reversal of this sequence is required to disengage the door from the hold open position, however, a greater force is required to pull the catch 144 up the steeper angled second ramp 140 compared to that required to push the catch 144 up the gentler angled first ramp 139. This difference in required force ensures that the door will remain in a held open position as long as required, while permitting a nearly normal opening force to temporarily lock the door in the hold open position.

Adjustment of the force needed to impel the catch 144 up the first ramp 139, and pull the catch 144 back up the second ramp 140, is modified with the aid of the adjustment wedge 146. When the rocker 142 rotates about the axle pin 142, a rocker face 145 engages a wedge face 152 of the adjustment wedge 146. The necessary rotation of the rocker 142 to allow movement of the catch 144 up the first ramp 139 is resisted by the adjustment wedge 146, with the adjustment wedge being pushed against the compression spring 150 and increasing the resistance to rotation of the rocker 142. The precise force can be easily adjusted with readily available tools by tightening or loosening the adjustment screw to change the position of the compression spring 150 (and consequently the position of the adjustment wedge 146).

Figure 5:
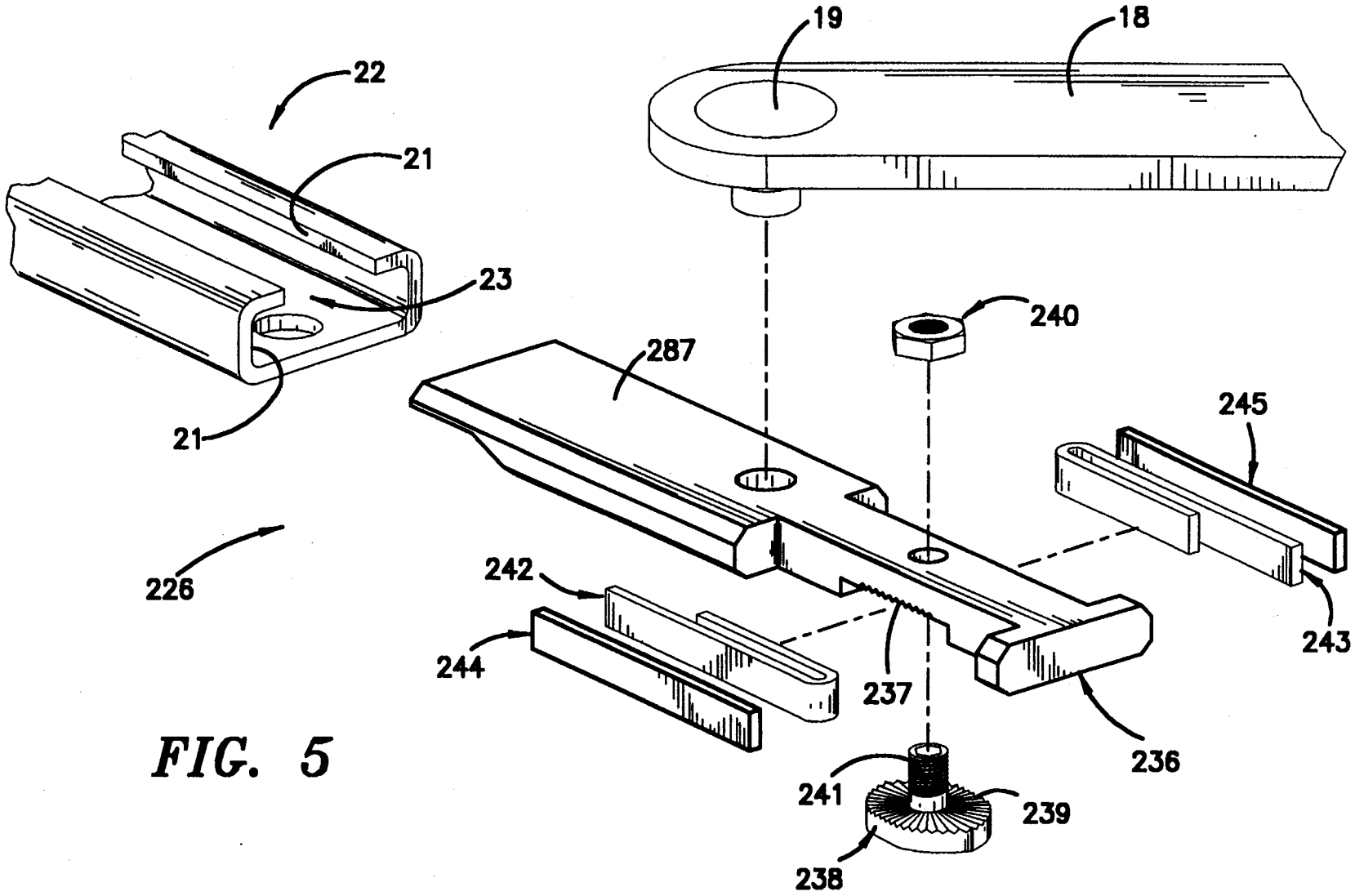
FIG. 5 is an exploded perspective view of another modular slide assembly suitable for placement in the channel assembly.

An alternative modular slide assembly that does not require a separate hold open assembly can also be inserted into the channel assembly 22. For example, as best illustrated in FIG. 5, a slide assembly 226 suitable for modular placement in channel assembly 22 can incorporate frictional engaging features for holding open a door. The slide assembly 226 includes a slider 236 having serrations 237 defined on it, first and second springs 242 and 243, first and second friction pads 244 and 245 (formed from brake lining or other wear and heat resistant material), and a friction cam 238 connected to the slider 236 by its shaft 241 and a nut 240, along with additional locking engagement being provided by matched locking of its serrations 239 and serrations 237 of the slider 236. The top surface of the slider 236 has an attached polymeric block 287 constructed from a nylon filled thermoplastic such as Nylatron TM that provides low friction and low wear engagement of the slider 236 with the channel assembly 22 and its channel walls 21.

The springs 242 and 243 have a generally U-shaped cross sectional shape, and are respectively positioned between the centrally located slider 236 and the first and second friction pads 244 and 245. When assembled, the springs 242 and 243 press the pads 244 and 245 against the channel walls 21 of the channel assembly 22, the exact amount of pressure being determined by the angle of rotation of the friction cam 238.

Figure 6:
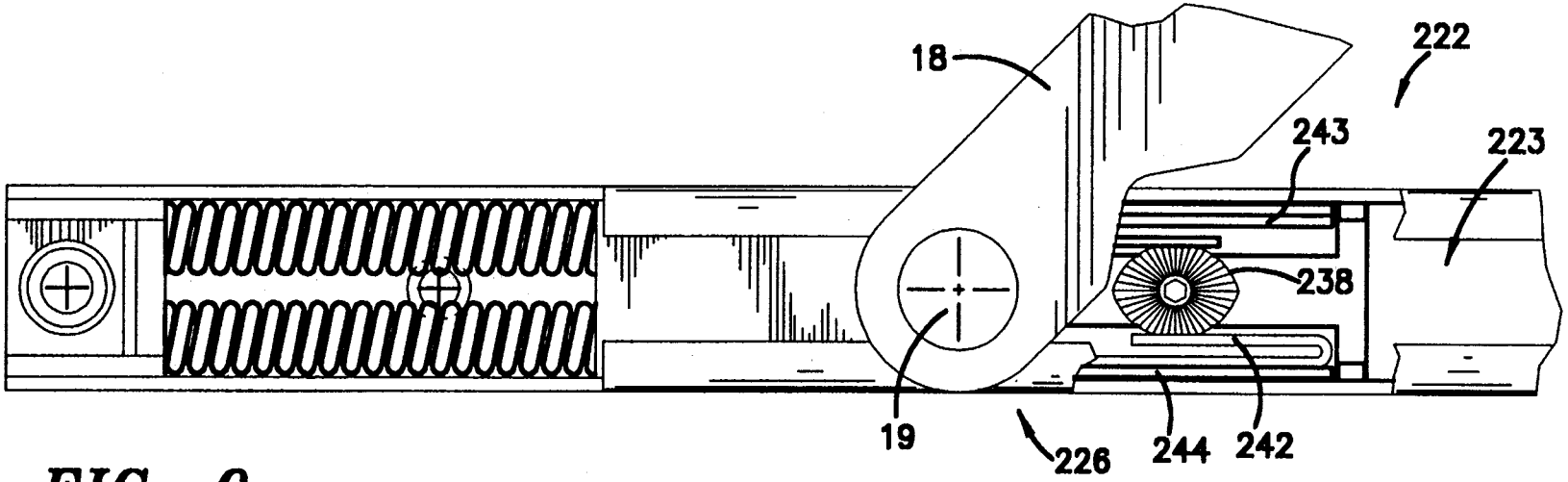
FIGS. 6 and 7 illustrate the slide assembly of FIG. 5 seated in a channel assembly, with the friction cam rotated to different positions in each of the Figures.
Figure 7:
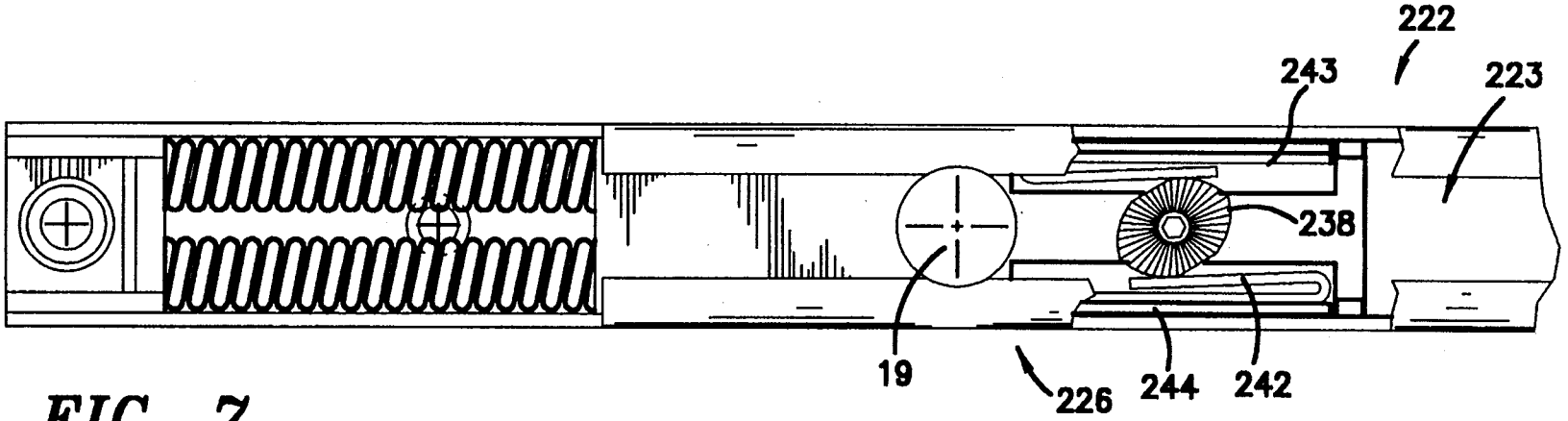

As best seen in FIGS. 6 and 7, the friction cam 238 has an elliptical cross section. As the cam 238 is rotated from a first position with the long axis of the ellipse parallel to the channel to an increasingly angled position with respect to the longitudinal axis of the channel assembly, the springs 242 and 243 are increasingly compressed. This compression of the springs 242 and 243 consequently results in greater static and dynamic frictional force exerted by the pads 243 and 244. Depending on the thickness, type of pad, door resistance, and other appropriate factors, the friction cam 238 cam be adjusted to compress the springs a desired amount by adjusting its rotational angle. When the friction cam 238 is set at the correct rotational angle, it is slightly rocked so that the serrations 237 of the slider and serrations 239 of the friction cam 238 mesh, providing resistance to movement out of position as the nut 240 is tightened on the shaft 241. Using easily available tools, the present invention allows simple and quick adjustment of door hold force.

As those skilled in the art will appreciate, other types of slide mechanism can also be used in conjunction with the standardized channel assembly of the present invention. The examples presented in the present specification are exemplary, and are not intended to limit the particular type of hold open stop, stop block, slider, or other modular mechanism suitable for use in conjunction with the channel assembly.

What is claimed is:

1. An overhead door holder assembly for attachment between a door jamb and a door for selectively holding the door in an open position, the assembly comprising a jamb bracket for attachment to a door jamb, a jamb arm pivotally attached to the jamb bracket, a channel assembly for attachment to a door having a channel therein defined by channel walls, a hold open assembly attached to the channel assembly, having a hold open stop fixed in the channel, the hold open stop including a stop element with a first ramp and a second ramp, and a slide assembly including a frame, pivotally attached to the jamb arm for movement in the channel in response to opening and closing of the door, and selectively engageable with the channel assembly to hold open the door, the slide assembly including a polymeric block in sliding contact with the channel, a rocker pivotally supported by the slide frame, the rocker having a catch and rocker face,the catch configured to slide over the first ramp for reversible engagement with the second ramp of the stop element to hold the door in an open position, and an adjustment wedge positioned to contact the rocker face for controlling the rocker catch with respect to the stop element, having a wedge slot therethrough, the wedge slot being configured to accommodate a position pin attached to the slide frame providing a predefined limited range of movement of the adjustment wedge with respect to the slide frame and the rocker.

2. The assembly of claim 1, further comprising a compression spring connected between the adjustment wedge and the slide frame to resist movement of the adjustment wedge as the catch of the rocker moves along the first ramp.

3. The assembly of claim 2, further comprising an adjustment screw configured to hold the compression spring attached to the slide frame to allow adjustment of bias of the compression spring.

4. The assembly of claim 1 wherein the polymeric block comprises a nylon filled thermoplastic.

5. The assembly of claim 4, wherein the nylon filled thermoplastic comprises Nylatron ®.

6. An overhead door holder assembly for attachment between a door jamb and a door for selectively holding the door in a open position, the door holder assembly comprising a jamb bracket for attachment to a door jamb, a jamb arm pivotally attached to the jamb bracket, a channel assembly for attachment to a door having a channel therein defined by channel walls, and a slide assembly, pivotally attached to the jamb arm for movement in the channel in response to opening and closing of the door, and selectively engageable with the channel assembly to hold open the door, the slide assembly comprising:

a polymeric block in sliding contact with the channel, a stepped surface portion, at least one friction pad having a frictional coefficient greater than the polymeric block for frictionally engaging the channel walls to hold open the door, at least one spring for urging the at least one friction pad against the channel assembly to fix the slide assembly at a predetermined position in the channel, and an adjustment assembly for varying a biasing force of the at least one spring, the adjustment assembly including a cam contacting the at least one spring, the cam having a step-wise adjustable surface confronting the stepped surface portion of the slide assembly and selectively engageable therewith to adjust the force applied by the at least one friction pad against the channel assembly.

7. The assembly of claim 6, wherein the at least one friction pad comprises a pair of friction pads confronting the channel walls, the cam being centrally located between the pair of friction pads.

8. The assembly of claim 7, wherein the at least one spring comprises a pair of U-shaped springs, each spring located between the cam and one of the pair of friction pads.

9. The assembly of claim 8, wherein the cam comprises an ovate head fixed to a shaft penetrating the polymeric block, the ovate head contacting one leg of each of the U-shaped springs, said head being selectively oriented to adjust the force applied by the U-shaped springs onto the friction pads.

10. The assembly of claim 6 wherein the polymeric block comprises a nylon filled thermoplastic.

11. The assembly of claim 10, wherein the nylon filled thermoplastic comprises Nylatron ®.

* * * * *